US009737451B2

(12) United States Patent
Hampe et al.

(10) Patent No.: US 9,737,451 B2
(45) Date of Patent: Aug. 22, 2017

(54) THERMOTHERAPY DEVICE

(71) Applicant: Dräger Medical GmbH, Lübeck (DE)

(72) Inventors: Markus Hampe, Lübeck (DE); Markus Kater, Herrnburg (DE); Claudia Kohnke, Lübeck (DE)

(73) Assignee: Drägerwerk AG & Co. KGaA, Lübeck (DE)

( * ) Notice: Subject to any disclaimer, the term of this patent is extended or adjusted under 35 U.S.C. 154(b) by 168 days.

(21) Appl. No.: 14/384,256

(22) PCT Filed: Mar. 22, 2013

(86) PCT No.: PCT/EP2013/056056
§ 371 (c)(1),
(2) Date: Sep. 10, 2014

(87) PCT Pub. No.: WO2013/144007
PCT Pub. Date: Oct. 3, 2013

(65) Prior Publication Data

US 2015/0038773 A1 Feb. 5, 2015

(30) Foreign Application Priority Data

Mar. 27, 2012 (DE) ..... 10 2012 006 192

(51) Int. Cl.
*A61G 11/00* (2006.01)

(52) U.S. Cl.
CPC ..... *A61G 11/005* (2013.01); *A61G 11/001* (2013.01); *A61G 11/002* (2013.01);
(Continued)

(58) Field of Classification Search
CPC ... A61G 2203/20; A61G 11/00–11/009; A61G 7/005–7/018; A61N 2005/0659;
(Continued)

(56) References Cited

U.S. PATENT DOCUMENTS 4,006,499 A * 2/1977 Young ..... A61G 7/002 5/608
5,624,375 A * 4/1997 Dykes ..... A61G 7/005 108/7

(Continued)

FOREIGN PATENT DOCUMENTS

CN 2704351 Y 6/2005
CN 201309816 Y 9/2009

(Continued)

*Primary Examiner* — Christine H Matthews
*Assistant Examiner* — Joshua D Lannu
(74) *Attorney, Agent, or Firm* — McGlew and Tuttle, P.C.

(57) ABSTRACT

A heat therapy appliance for treatment of neonates has a lying surface on a platform bordered by side walls, a hood movable between a closed incubator position, bearing on the side walls and covering the lying surface, and an open nursing care position, a radiant heater secured on the appliance structure and directed at the lying surface, lifting devices acting on the platform, and a control device actuating the lifting devices to adjustably set an angle of inclination of the platform with respect to the horizontal. The platform is mounted so as to be adjustable in height. The control device also actuates the lifting devices in the same direction, to adjust the vertical position of the platform with respect to the side walls between a first position and a second position higher than the first position.

20 Claims, 11 Drawing Sheets

(52) U.S. Cl.
CPC ..... *A61G 11/006* (2013.01); *A61G 11/008* (2013.01); *A61G 11/009* (2013.01); *A61G 2210/50* (2013.01)

(58) Field of Classification Search
CPC ..... A61N 5/0625; A61N 5/0614; A61F 7/00; B66F 11/00–11/046
See application file for complete search history.

(56) References Cited

U.S. PATENT DOCUMENTS

| | | | | |
|---|---|---|---|---|
| 5,759,149 | A * | 6/1998 | Goldberg | A61M 16/109 600/22 |
| 6,155,970 | A | 12/2000 | Dykes et al. | |
| 6,213,935 | B1 | 4/2001 | Mackin et al. | |
| 6,231,499 | B1 | 5/2001 | Jones | |
| 6,296,606 | B1 | 10/2001 | Goldberg et al. | |
| 6,351,678 | B1 * | 2/2002 | Borders | A61F 7/007 5/600 |
| 6,611,978 | B1 * | 9/2003 | Schmidt | A61G 11/00 5/603 |
| 2005/0028286 | A1 * | 2/2005 | Smart | A47D 13/08 5/655 |
| 2010/0113864 | A1 | 5/2010 | Matsubara et al. | |
| 2011/0010858 | A1 * | 1/2011 | Tesar | A61G 7/005 5/608 |

FOREIGN PATENT DOCUMENTS

| | | | | |
|---|---|---|---|---|
| DE | 691 03 387 | T2 | 12/1994 | |
| DE | 696 35 498 | T2 | 8/2006 | |
| EP | 0 541 981 | A1 | 5/1993 | |
| GB | 2386062 | A * | 9/2003 | A47C 19/045 |
| WO | 01/43 686 | A2 | 6/2001 | |
| WO | 02/24 138 | A2 | 3/2002 | |
| WO | 03/017 908 | A1 | 3/2003 | |
| WO | WO 2009073444 | A1 * | 6/2009 | A61G 11/00 |

* cited by examiner

THERMOTHERAPY DEVICE

CROSS REFERENCE TO RELATED APPLICATIONS

This application is a United States National Phase Application of International Application PCT/EP2013/056056 filed Mar. 22, 2013 and claims the benefit of priority under 35 U.S.C. §119 of DE 10 2012 006 192.7 filed Mar. 27, 2012, the entire contents of which are incorporated herein by reference.

FIELD OF THE INVENTION

The present invention pertains to a thermotherapy device for the treatment of newborns with a reclining surface bordered by side walls on a platform; with a hood, which can be moved between a closed position, which is in contact with the side walls and covers the reclining surface, for incubator operation, and an open position releasing the bordered reclining surface for open nursing care; with a heating radiator, which is secured to the device structure and is directed at the bordered reclining surface; with a lifting means acting on the platform; and with a control means, which is set up the make the tilt angle of the platform in relation to the horizontal adjustable by actuating two lifting means.

BACKGROUND OF THE INVENTION

There are two therapeutic approaches in the care of newborns. The infants are placed into so-called incubators in case of closed nursing care. These can offer an environment tailored to the infant's needs with moist, warm and possibly even oxygen-enriched air. The patient space of the incubator comprises a reclining surface on a platform, which is surrounded by side walls. A hood closes the patient area upwardly. To reach the infant, so-called hand ports can be opened in the side walls, or even a complete side wall can be folded down if needed.

The second therapeutic approach provides for placing the premature infant into open nursing care beds, which make it possible to warm the infant by heating radiators. These warming beds offer easier access to the infant for the nursing care staff compared to the closed incubators. The side walls protecting the infant from falling out typically have a height of 150 mm, so that the nursing care staff can reach into the device over the side walls. The side walls of an incubator are typically higher, because a certain volume of air is needed within the incubator and to make better access to the infant possible with the side walls open.

The incubator and warming bed device types are combined with one another in so-called hybrid devices. To pass over from closed nursing care to open nursing care, the hood is removed from the side walls and the infant is warmed by means of heating radiators. Such hybrid devices are described, for example, in U.S. Pat. No. 6,213,935, U.S. Pat. No. 6,231,499 and US 2010/0113864. The side walls protecting the infant have a height of, for example, 170 mm or 240 mm when the hood is opened in the commercially available devices. Access to the infant is thus rather unfavorable with the side walls closed and the hood opened, because the nursing care staff must reach into the patient area over the side walls or fold down the side walls in a cumbersome manner. The infant must not be left unsupervised at any time with the side walls folded down. One approach points in the direction of reducing the height of the side walls and of making available an additional volume through a high hood. However, this leads to a reduced freedom during working in closed nursing care (hood closed) with the side wall opened.

One approach towards solving the problem of accessibility is described in US 2010/0113864. A mechanism makes it possible to position the side walls in both a closed position and an opened position as well as in an intermediate position. The drawback of this solution is, however, that all side walls must be brought one by one into the intermediate position in order to gain good access to the infant from all sides. This may be very cumbersome in stress situations. Furthermore, a basically error-prone, expensive and bulky mechanism must be integrated in the patient bed.

SUMMARY OF THE INVENTION

An object of the present invention is to provide a hybrid device of the type mentioned in the introduction such that good accessibility to the reclining surface is guaranteed with the hood open.

According to the invention, a thermotherapy device is provided for treating newborns. The thermotherapy device comprises a reclining surface, bordered by side walls, on a platform, a hood movable between a closed position, which is in contact with the side walls and covers the reclining surface, for incubator operation, and an open position releasing the bordered reclining surface for open nursing care, a heating radiator, which is secured to the device structure and is directed at the bordered reclining surface, a lifting means (lifting device) acting on the platform; and a control means (control device) that is set up to make the tilt angle of the platform in relation to the horizontal adjustable by actuating the lifting means. Provisions are made, according to the present invention, for the platform to be mounted in a vertically adjustable and tilt-adjustable manner in relation to the side walls with two individually actuatable lifting devices. Further, the control means is set up to make the vertical position of the platform in relation to the side walls adjustable at least between a first, lowered position, especially for the incubator operation, and a second position, which is raised relative to the first position, by actuating the lifting means in the same direction (by actuating each lifting device in the same direction).

As a result, the reclining surface can be brought into the second, raised position in relation to the side walls in case of open nursing care, so that good accessibility is guaranteed.

The lifting means is preferably comprised of electrically driven telescopic devices. However, a hydraulic or pneumatic drive is also possible, in principle.

The platform can be brought into a position tilting upwardly to the head end or the foot end by actuating the lifting means in opposite directions (actuating each of two lifting devices in opposite directions). Such positions are necessary for certain forms of therapy on the infant (Trendelenburg/anti-Trendelenburg positioning). This tilt adjustment may be possible both in the lowered position and the raised position of the platform.

An insertion slot or slide-in box, which is connected with the platform and is used to receive an X-ray film or a digital X-ray cassette, is usually located under the platform. As a result, the newborn infant can examined radiologically without repositioning and without interruption of the thermotherapy. The vertical adjustment provided according to the present invention may be advantageously used to raise the platform to the extent that the X-ray apparatus is accessible via the lateral hand ports unless a vertical middle web is left in place at the side wall with the hand ports open. The X-raying can thus take place in closed nursing care without a major interference with the therapy. No further opening is necessary on the device for the access to the X-ray apparatus in open nursing care as well as in closed nursing care.

In a preferred embodiment, the platform can be controlled via the lifting means by means of a keyboard with four keys in such a way that the actuation of a first key brings about a pure lifting motion, that of a second key, a pure lowering motion, that of a third key, a pure tilt adjustment of the platform in one direction, and that of a fourth key, a pure tilt adjustment of the platform in the opposite direction.

The control means is set up in a preferred embodiment to continue the resulting motion of the platform when actuating one of the keys only as long as the corresponding key is kept depressed and to stop the motion automatically when the next normal or end position is reached.

The fact that the adjustment of the height and tilt of the platform is brought about by means of an electric motor is utilized in a preferred embodiment. The signals for energizing the electric motor drive are analyzed here such that the tilt of the platform and the distance of the platform from the heating radiator are known. If the position of the platform is known, the radiation output can be correspondingly adapted to the position, i.e., to the distance of the infant from the heating radiator and to the infant's orientation to the heating radiator. If, for example, the platform is raised or tilted in the direction of the heating radiator, the radiation output can be lowered.

The present invention will be described below on the basis of exemplary embodiments shown in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
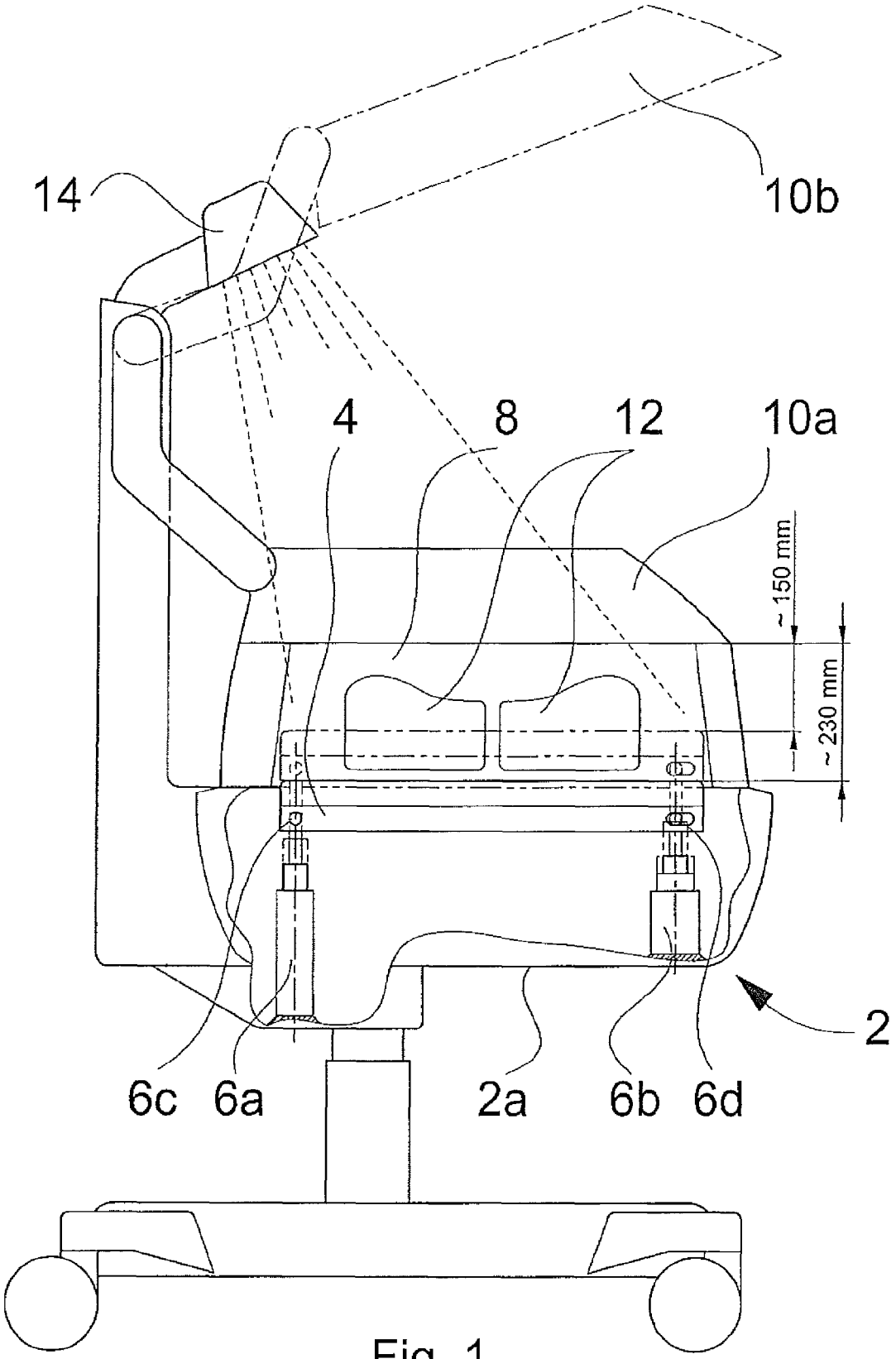
FIG. 1 is a schematic side view of a thermotherapy device with two telescopic lifting means and with the platform in the lowered position and with the hood closed, drawn in solid lines, as well as with the platform in the raised position, drawn in broken lines.

Referring to the drawings in particular, the thermotherapy device 2 in FIG. 1 has a platform 4, which is provided with a reclining surface for the infant and which is mounted with a lifting means comprising two telescopic lifting devices 6*a*, 6*b* adjustably in relation to the device chassis 2*a* and hence also in relation to the side walls 8. The lifting devices 6*a*, 6*b* are securely anchored in the chassis and are designed in terms of the telescopic guides such that the platform 4 can be mounted on them in a self-supporting manner with sufficient rigidity by means of two cross members 6*c*, 6*d*.

The lowered normal position of the platform with the hood 10*a* closed is indicated by solid lines, and the raised position with the hood opened is indicated by broken lines.

With the hood closed, the infant can be reached via hand ports 12, which can be opened one by one, or, if better accessibility is necessary, by folding down a side wall 8. It is advantageous for this if the side walls are rather high relative to the platform 4 (approximately 230 mm in the exemplary embodiment).

With the hood opened, the heating radiator 14 secured to the device structure warms the infant. The platform 4 is indicated by broken lines in a vertically raised position. The side walls 8 enclose the patient bed in this position with a height of about 150 mm only, which facilitates access to the infant for the nursing care staff, but at the same time offers sufficient safety against the infant falling out.

Figure 2:
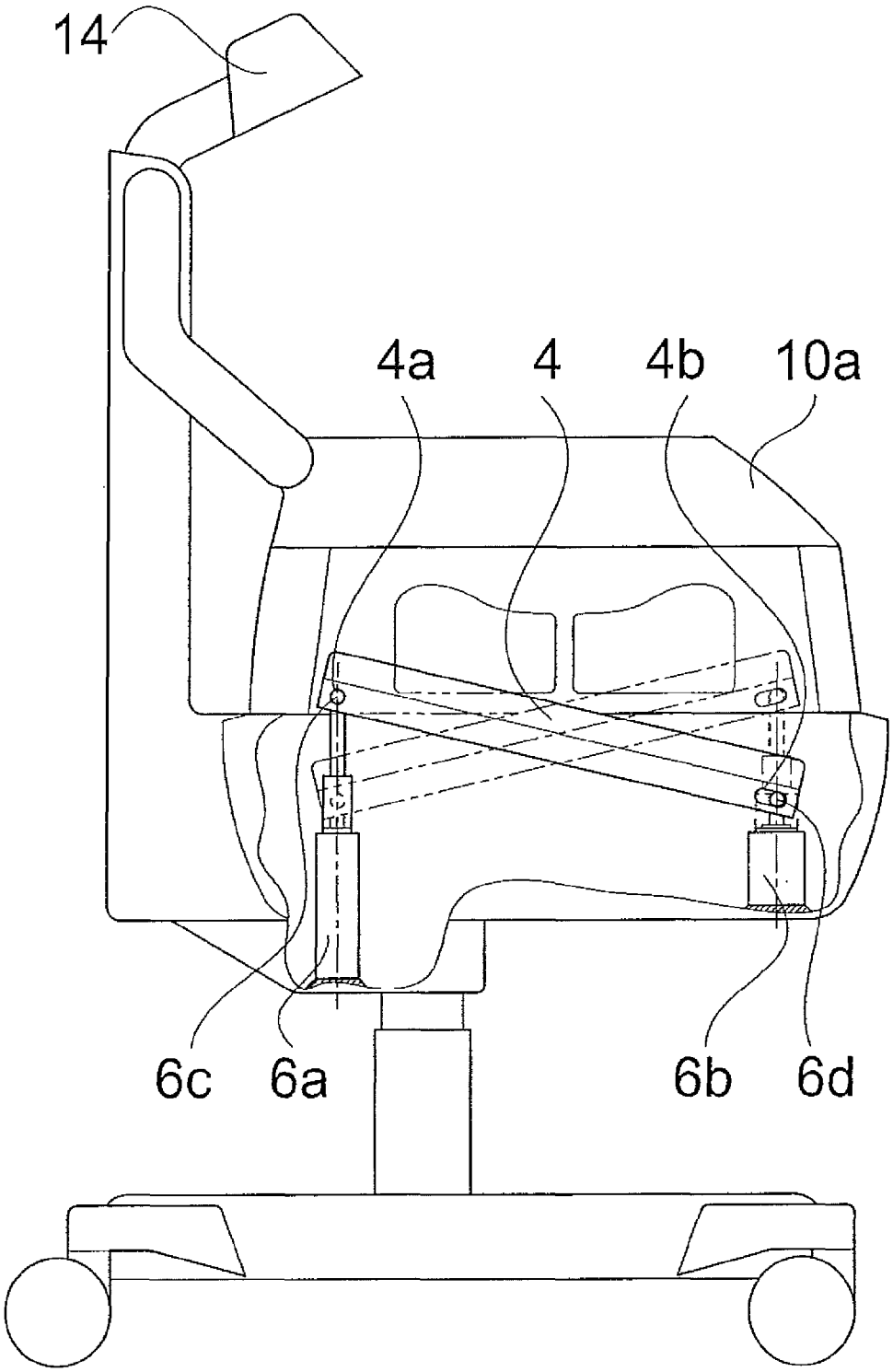
FIG. 2 is a schematic side view as shown in FIG. 1, with the hood closed and with the platform in the lowered position at two different tilt angles.

FIG. 2 shows the thermotherapy device from FIG. 1 with the hood 10*a* closed. The platform 4 can be brought, when viewed from the side, into different angular positions in relation to the device 2 and hence in relation to the side walls 8 by moving the two lifting devices 6*a*, 6*b* of the lifting means in opposite directions in order to thus make possible, if necessary, a corresponding positioning of the infant.

Due to the platform 4 being mounted on the cross members 6*c*, 6*d* by means of a pivot bearing 4*a* and an elongated hole-shaped bearing 4*b*, the distance between the cross members, which increases when the tilt is being adjusted, can be compensated according to the principle of a fixed mount/movable mount combination.

Figure 3:
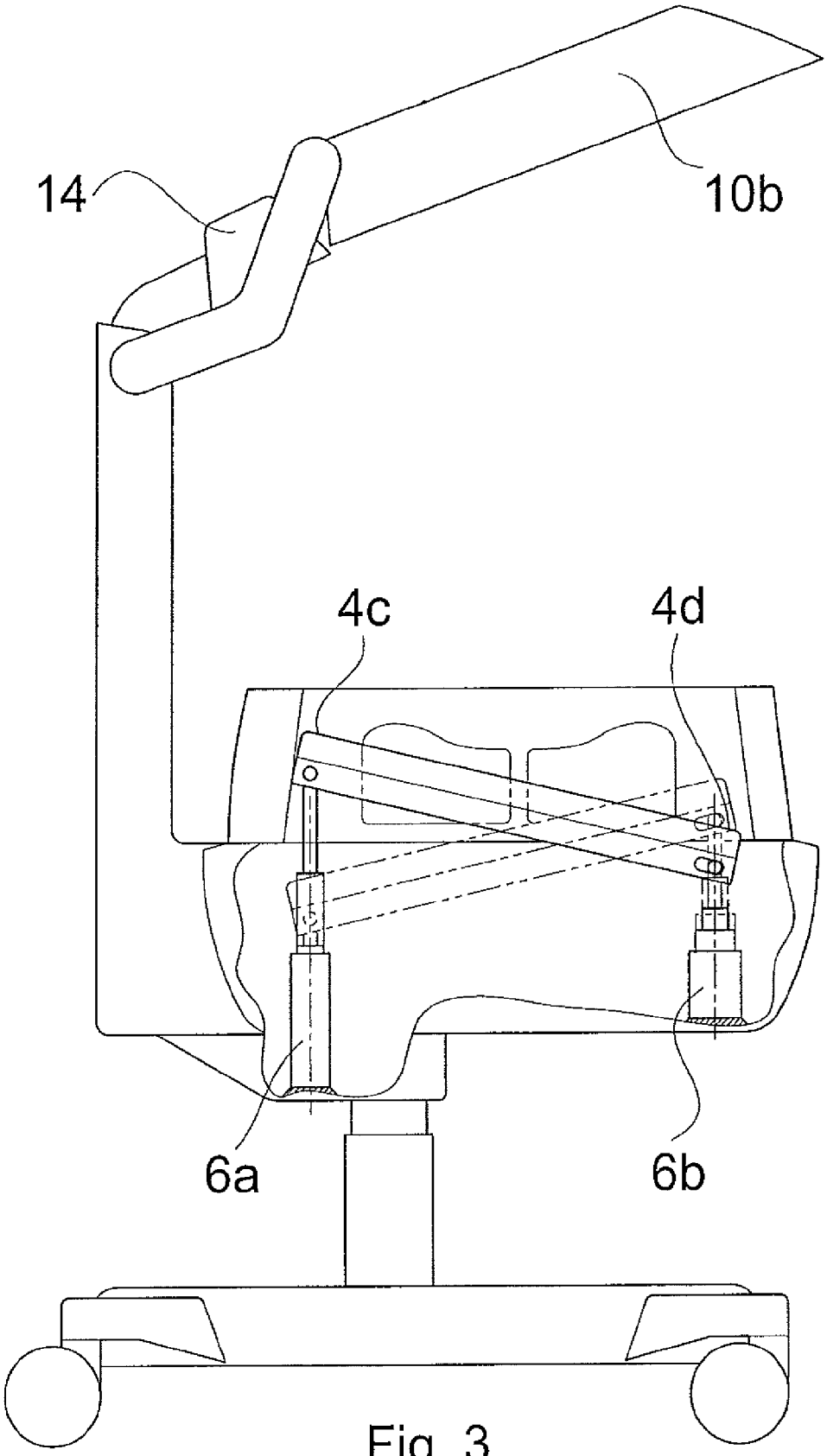
FIG. 3 is a schematic side view as shown in FIG. 1, with the hood opened and with the platform in the raised position at two different tilt angles.

FIG. 3 shows the thermotherapy device from FIGS. 1 and 2 with the hood opened. The platform 4 can also be brought from the raised position into different angular positions by moving the lifting devices 6*a*, 6*b* of the lifting means in different directions. Since the lifting device 6*b* has only a small vertical space available for its installation and hence a limited stroke in the exemplary embodiment, it may be advantageous that an angular position with the foot end of the platform 4*d* upward can be obtained only by the lifting device 6*b* not extending any farther but only the lifting device 6*b* moving downward. Such a limitation is insignificant, because the tilted positioning with the head end 4*c* upward is needed substantially more frequently, and the platform is shown by solid lines in this position in FIG. 3 and is indicated by broken lines in the position pivoted in the opposite direction.

Figure 4:
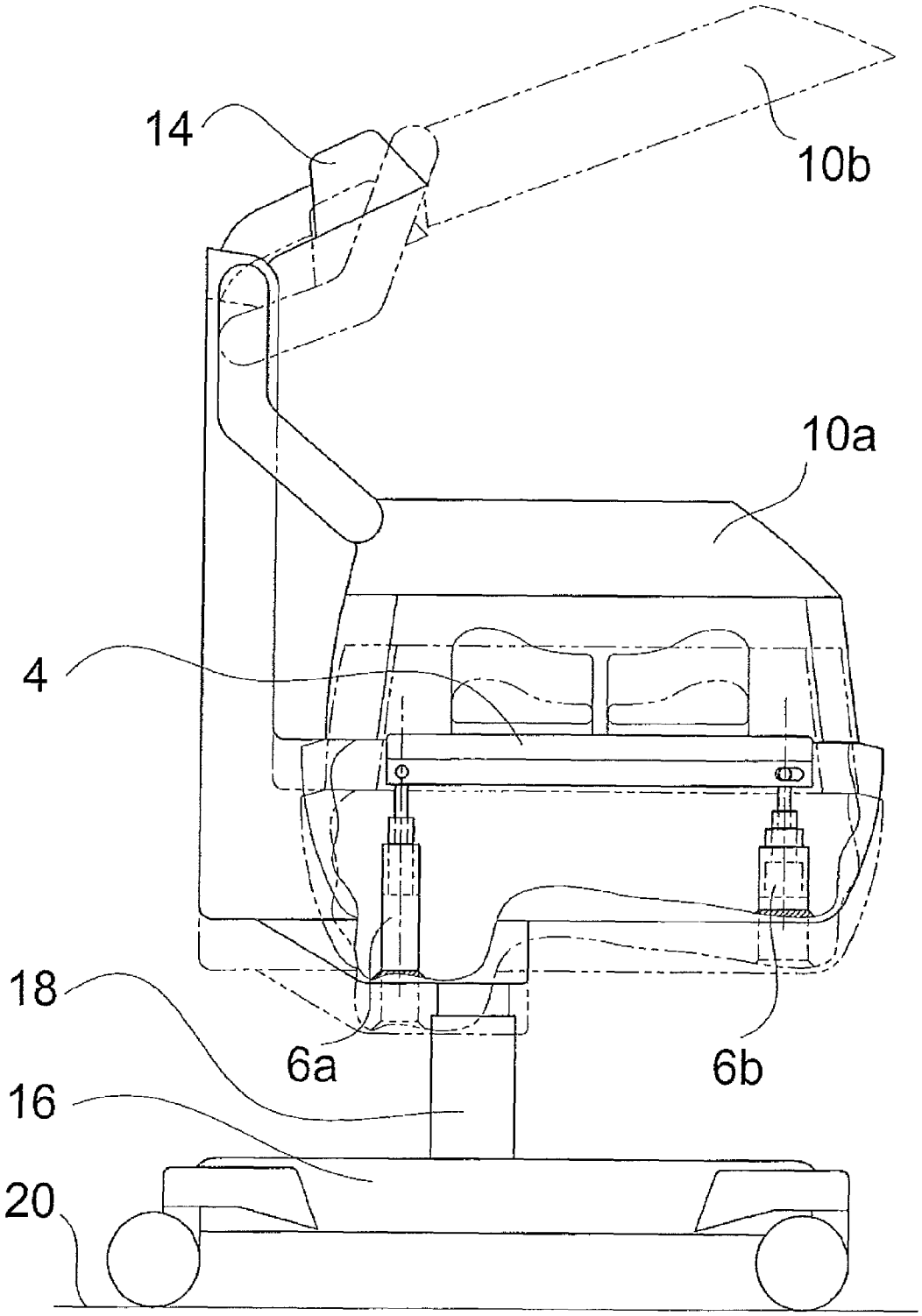
FIG. 4 is a schematic side view as shown in FIG. 1, wherein the vertical adjustment of the device via a lifting column can compensate the vertical adjustment of the platform.

Further, FIG. 4 shows the same exemplary embodiment as FIG. 1. The state with the hood closed is indicated by solid lines, and the state with the hood opened by broken lines.

However, the advantage that the overall device also has a motor-driven lifting column 18 in relation to a chassis (support chassis) 16 is utilized here. To make possible an unchanged vertical position, i.e., unchanged height of the platform 4 and hence of the infant in relation to a floor plane 20 during a transition from the state with the platform 4 lowered to the raised platform (and vice versa), the lifting devices 6*a*, 6*b* of the lifting means are synchronized with the lifting column 18 such that the platform 4 always maintains the same height in relation to the support chassis 16 and hence the floor plane 20. Thus, a vertical adjustment once selected for ergonomic reasons is preserved regardless of the state of the device.

Figure 5:
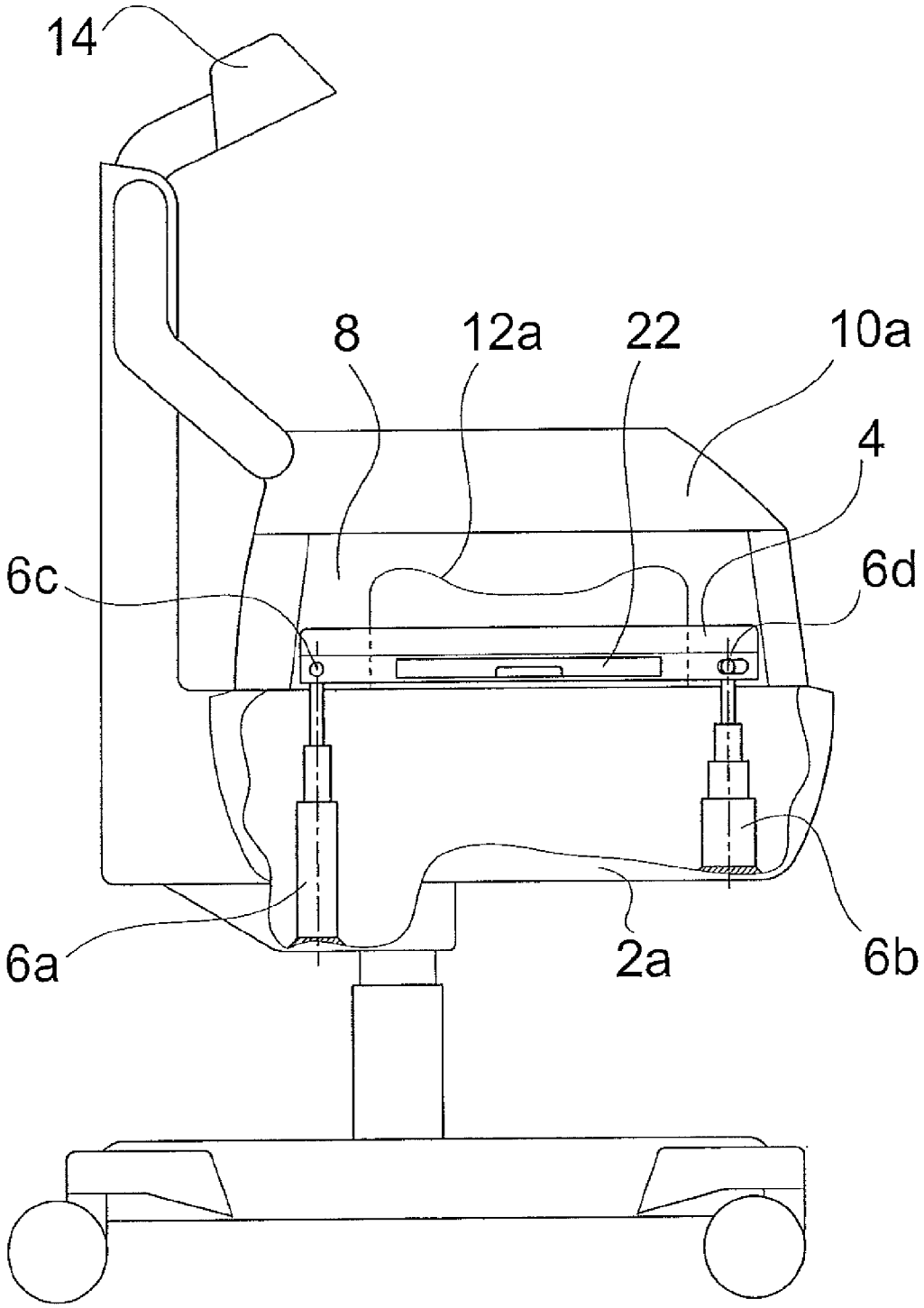
FIG. 5 is a schematic side view as shown in FIG. 1, but only with the hood closed and with the platform with the X-ray apparatus located under it in the raised position as well as with a hand port opening without vertical middle web.

FIG. 5 shows how the vertical adjustment of the platform 4 can be used to make an X-ray drawer 22, which can be pulled out laterally and is arranged under the platform, accessible without vertical middle web. The raised position is set in this exemplary embodiment without opening the hood, and the hand ports are opened on one side. The X-ray drawer 22 can then be pulled out laterally in order to insert an cassette. An insertion slot, into which an X-ray cassette is inserted, may also be present instead of the X-ray drawer 22.

Without the function being described here, an additional lateral opening would be needed on the device under the side walls 8 to make the drawer or the slot accessible.

Figure 6:
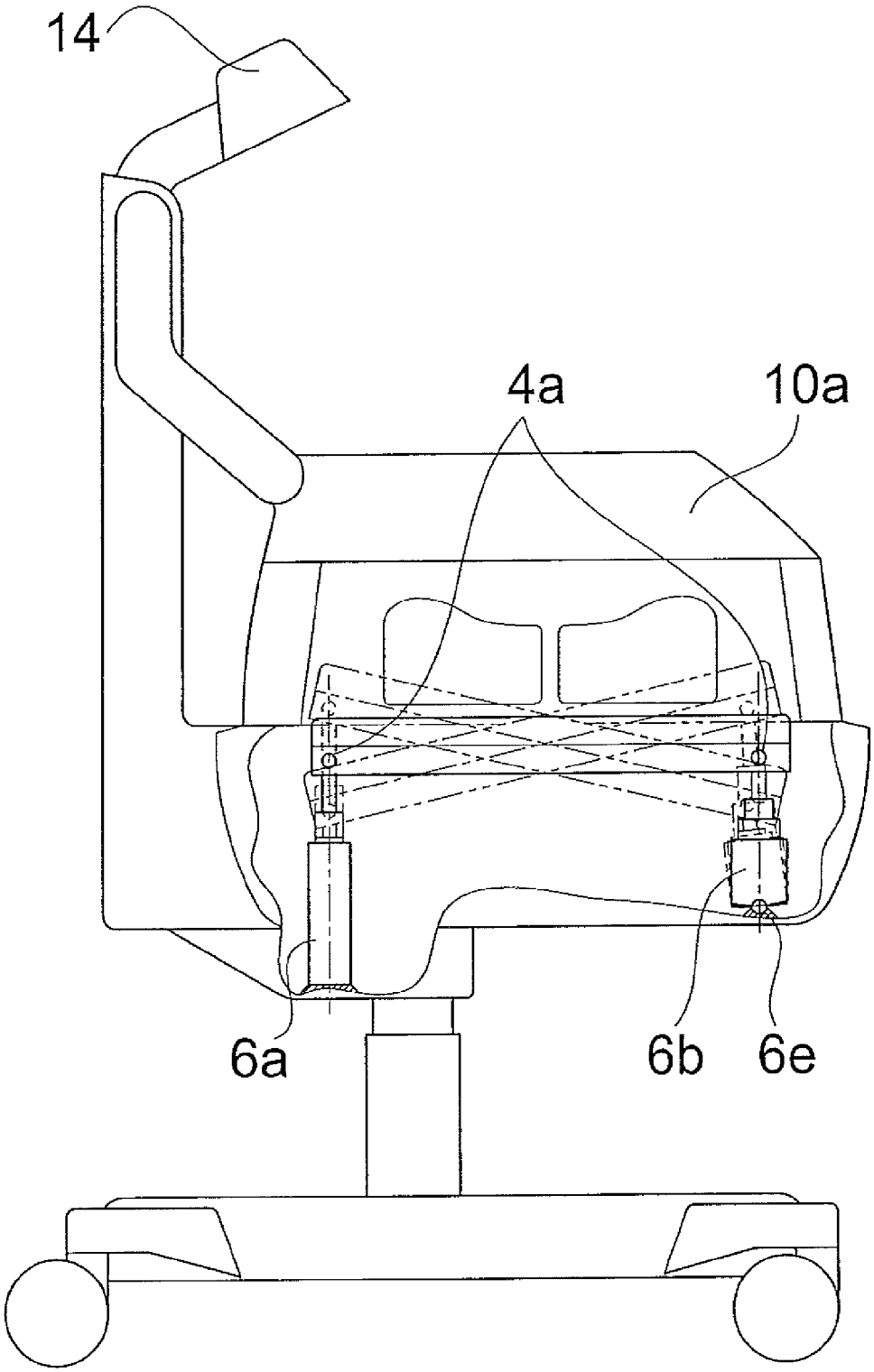
FIG. 6 is a schematic side view as shown in FIG. 1, wherein one of the two telescopic lifting devices, of the lifting means, are mounted rotatably on the device.

FIG. 6 shows an alternative embodiment for positioning the platform 4 on the lifting devices 6*a*, 6*b* of the lifting means. As described in FIG. 2, a length change compensation, during tilt adjustment, of the platform is provided via a fixed mount/movable mount combination 4*a*, 4*b*. The compensation is achieved according to the embodiment of FIG. 6, instead, by means of two pivot bearings at the platform 4*a* and an additional pivot bearing at the bottom at the lifting device 6*b*, so that the lifting device 6*b* is in a somewhat oblique position with the patient bed tilted, as this can be recognized from the positions indicated by broken lines.

Figure 7:
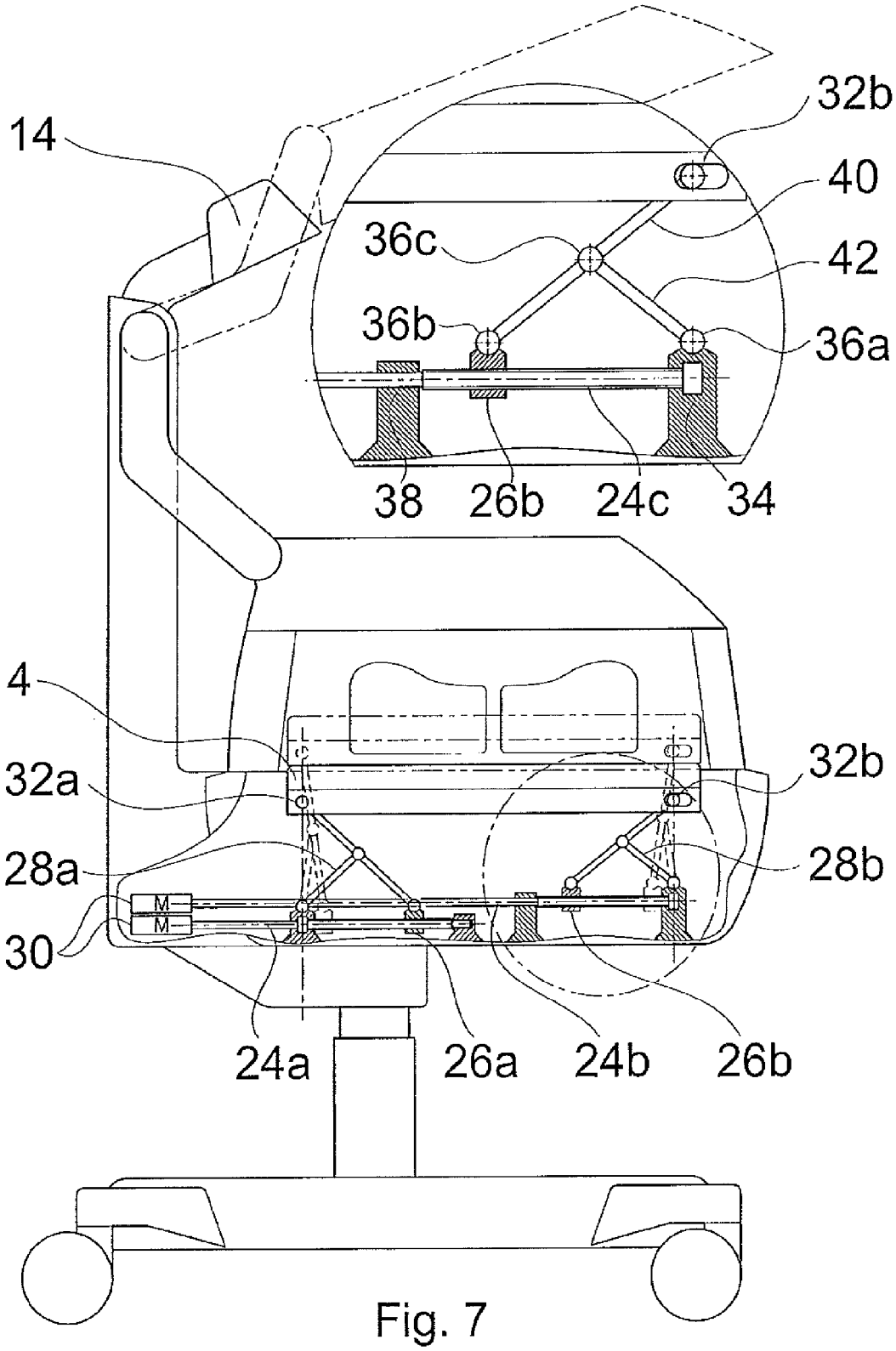
FIG. 7 is a schematic side view as shown in FIG. 1, but with two slidable lattice grate-like lifting devices, of the lifting means, as well as one of the slidable lattice grates as an enlarged detail.

FIG. 7 shows an alternative embodiment for the two lifting device of the lifting means. These are based on two horizontally positioned spindle shafts 24*a*, 24*b*, which drive two simple slidable lattice grates 28*a*, 28*b* via nuts 26*a*, 26*b* mounted thereon. The rotary motion of the spindle shafts 24*a*, 24*b* driven via motors 30 is transformed thereby into a pure vertical motion at the supports 32*a*, 32*b* to the platform 4. The mechanism is shown in two positions: With the platform lowered by solid lines and with the platform raised by broken lines.

A detail view shows the following further details for this:

Thrust bearing 34 for the spindle shaft and pivot bearing 36*a* for the short lever Motion thread 24*c* on the spindle shaft Spindle supporting mount 38

Nut 26*b* with pivot bearing 36*b* for the long lever

Long lever 40

Short lever 42, which is exactly half as long as the long lever 40

Hinge point 36*c* between the long and short levers.

Arrangement of the motors 30 at a distance from the patient area is advantageous in this exemplary embodiment, which means, on the one hand, a lower noise exposure for the infant, and, on the other hand, the motors are kept away from the oxygen-enriched air prevailing in the patient area, which improves fire safety. The mechanism permits, moreover, a long vertical stroke while the vertical space needed is small.

Figure 8:
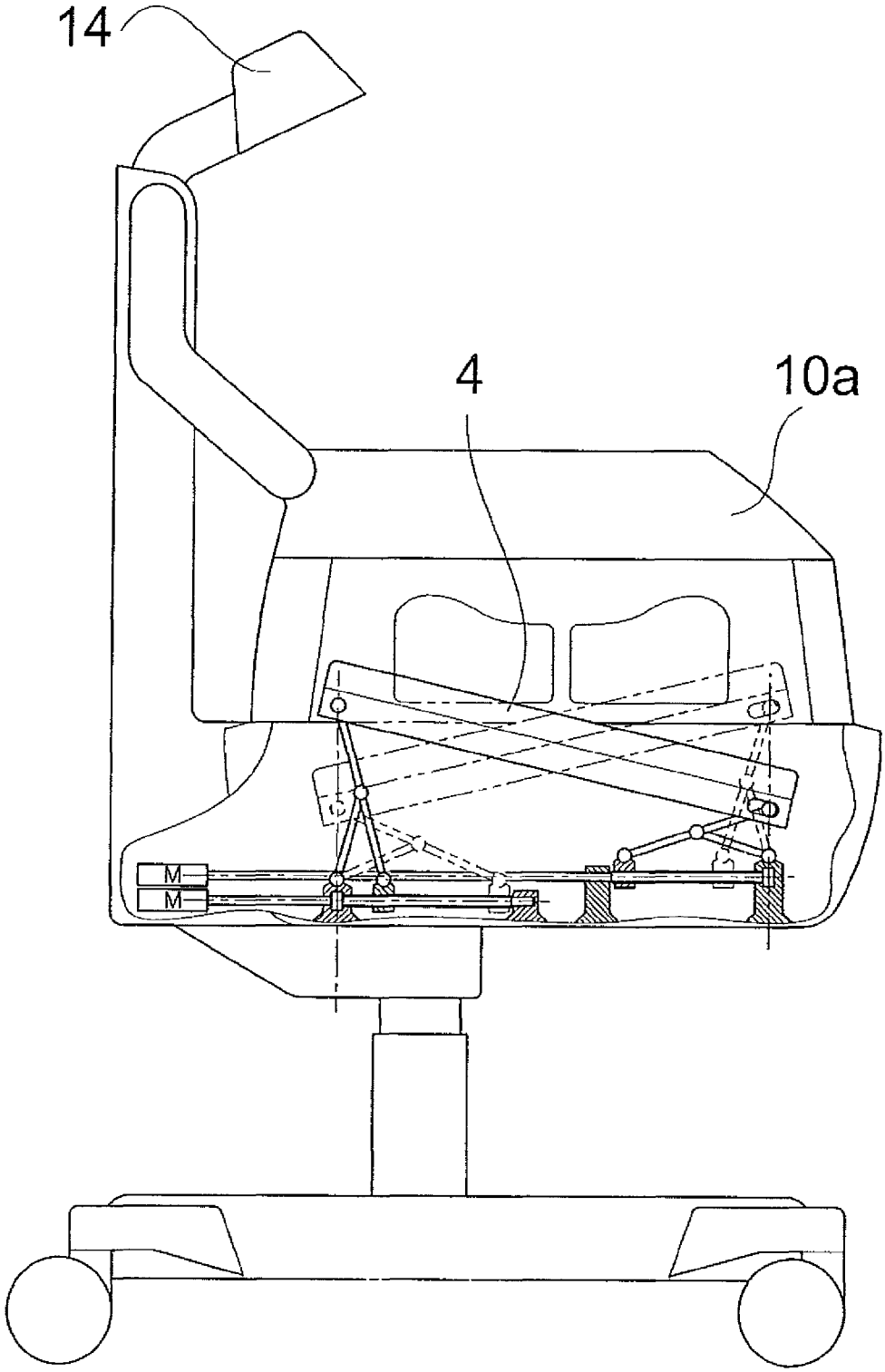
FIG. 8 is a schematic side view as shown in FIG. 2, but with the lifting means according to FIG. 7.

FIG. 8 shows the same exemplary embodiment as FIG. 7, but as an example with the platform 4 tilted upwardly towards the head end, indicated by solid lines, and with the platform tilted upwardly towards the foot end, indicated by broken lines.

Figure 9:
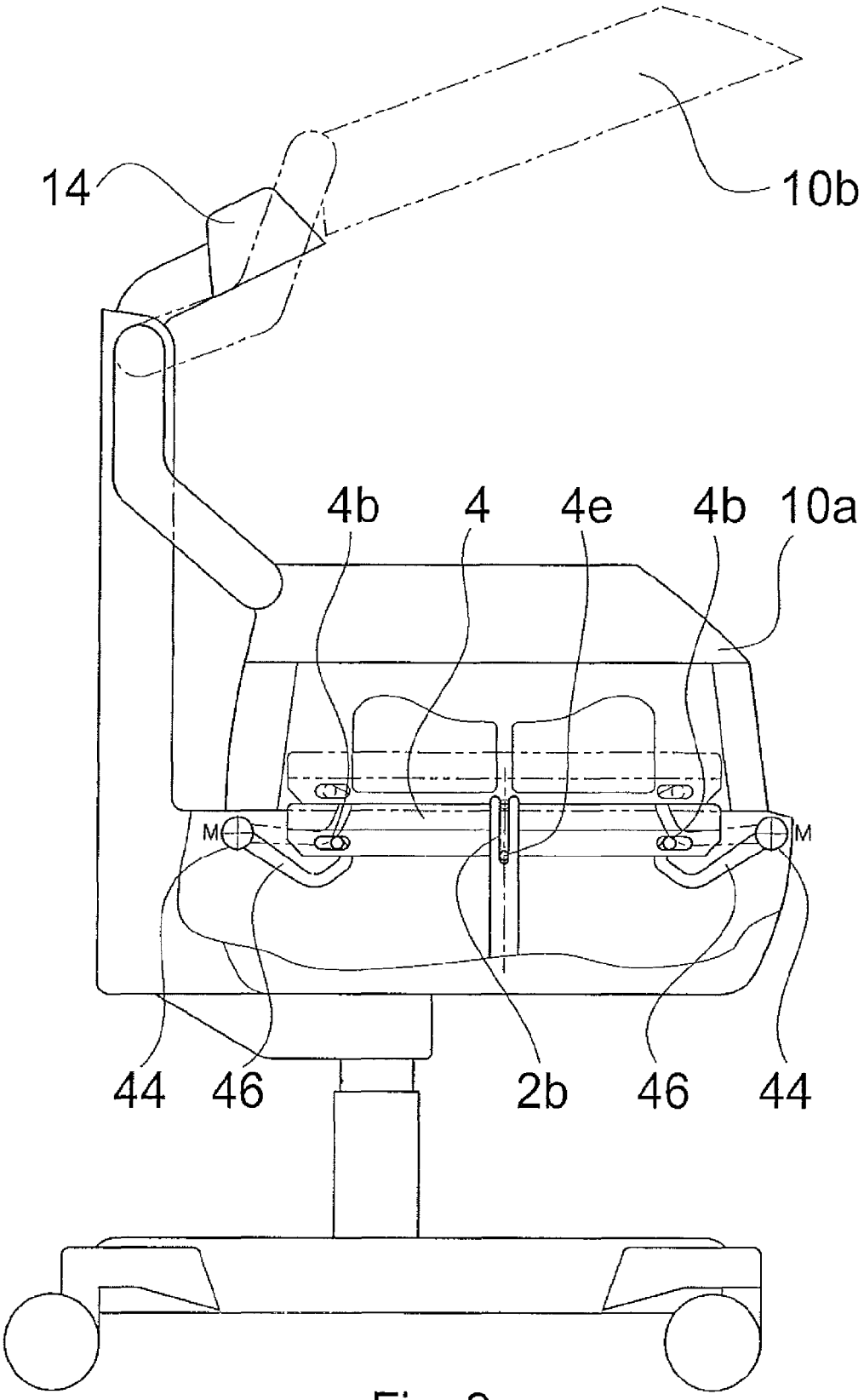
FIG. 9 is a schematic side view as shown in FIG. 1, but with two lifting devices, of the lifting means, designed as lever arms.

FIG. 9 shows a third principle of operation for the lifting means. Two gear motors 44 with high torque are arranged in front of the foot end and behind the head end of the platform 4. The motion of the motors is transmitted with levers 46 to the platform 4, which is mounted with two elongated hole-shaped mounts 4*b* on the levers. The exact horizontal positioning of the platform is performed by a centrally arranged, vertical guide, comprising in the exemplary example a device-side slot 2*b*, in which a round pin 4*e* slides at the platform 4.

The lowered platform 10*a* is again indicated by solid lines, and the raised platform with the hood 10*b* opened by broken lines. The raising and lowering of the platform are performed here by rotating the motors 44 in opposite directions.

Figure 10:
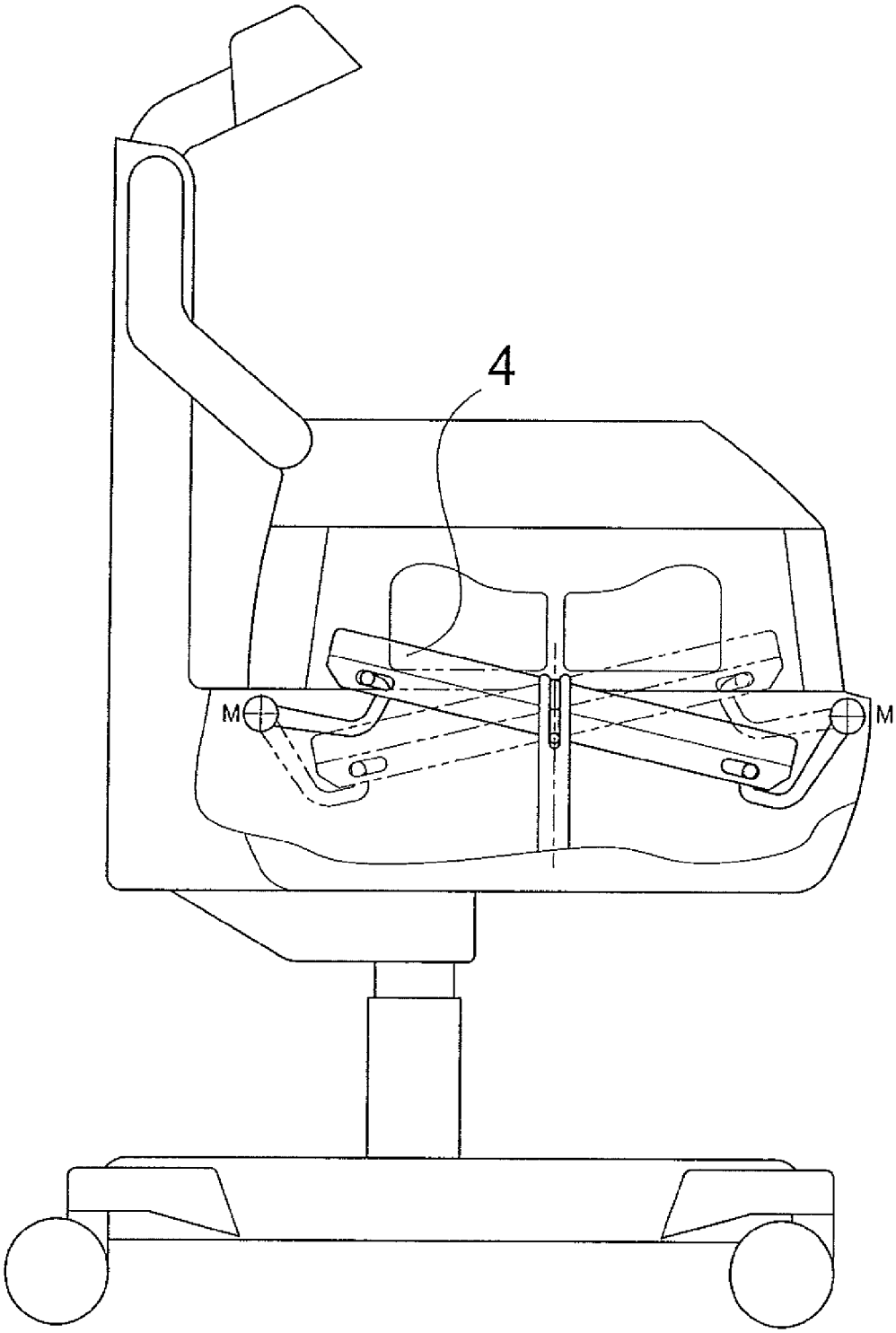
FIG. 10 is a schematic side view as shown in FIG. 2, but with the lifting means according to FIG. 9.

FIG. 10 shows the exemplary embodiment as FIG. 9, but as an example with the platform 4 tilted upwardly at the head end, indicated by solid lines, and with the platform tilted upwardly towards the foot end, indicated by broken lines.

Figure 11:
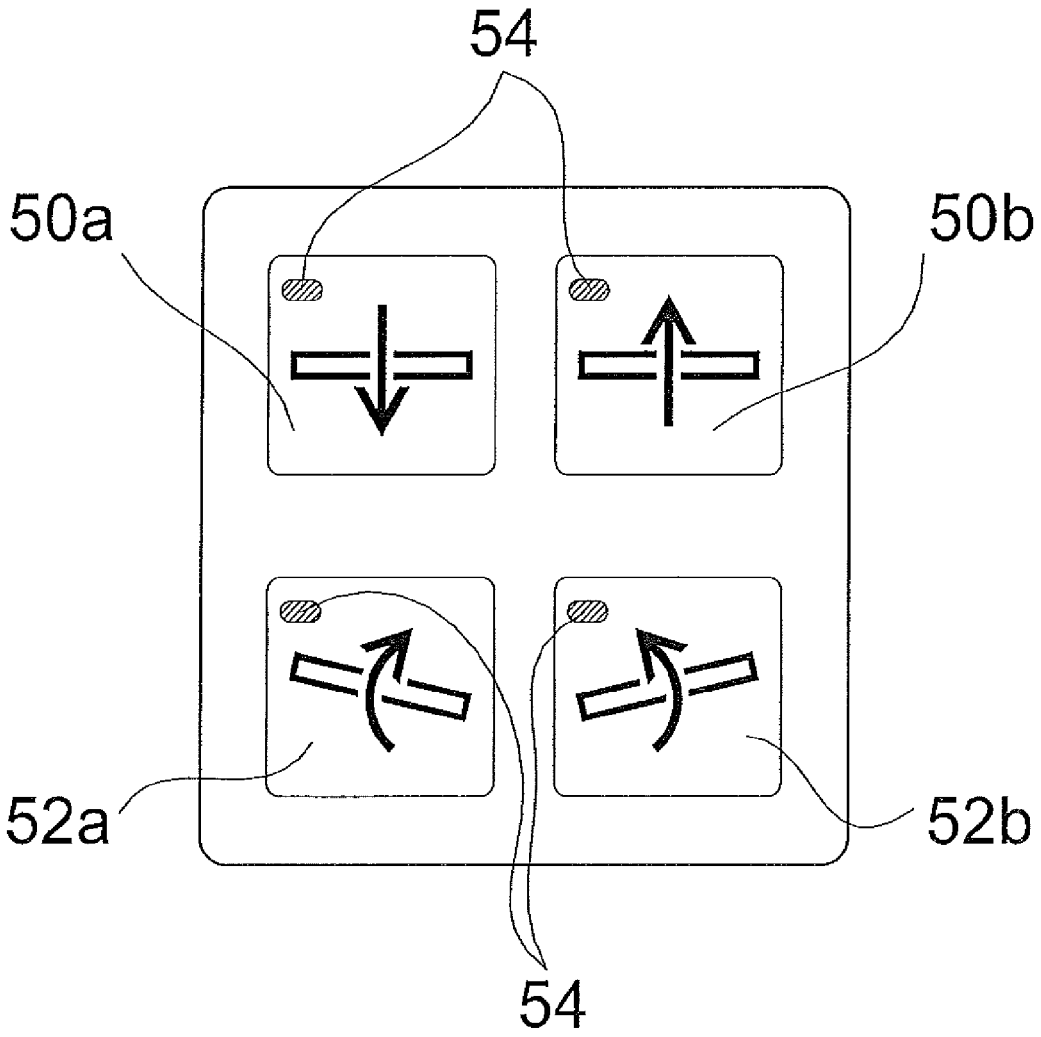
FIG. 11 is a schematic front view of a control panel, with which the lifting means can be actuated.

FIG. 11 shows an operating concept of how the lifting devices 6*a*, 6*b* of the lifting means, or even the alternative lifting means from FIG. 7 and FIG. 9 can be actuated. The drive concept provides for the lifting devices being driven by electric motors and for the lowered normal position being able to be detected by means of integrated switches. In addition, both lifting devices of the lifting means contain an incremental shaft encoder each, so that the software can calculate the actual position starting from the normal position by interpolation. When approaching or passing through the normal position, the system calibrates itself each time automatically.

The operating concept for moving the platform 4 provides for four keys: One key 50*a* for lowering, one key 50*b* for raising, one key 52*a* for tilting with raising of the head end and one key 52*b* for tilting with raising the foot end. Each key is provided with an LED field 54.

The operating logic proposed is as follows: It is already preset by the keys that the motors are actuated each only in exactly the same direction (raising/lowering) or exactly in opposite directions (tilting), i.e., no superimposed motions can take place. When a plurality of keys are pressed simultaneously, for example, only the key pressed first is taken into account. For safety reasons, motion always takes place only when the key is kept pressed in order to prevent uncontrolled states (e.g., jamming or slipping of tubes and cables, sliding of the infant) from being able to occur in the patient area. The motion stops automatically in the next possible normal or end position, so that these positions can be reached automatically. If a motion shall take place beyond a normal position, the key must either be released and then pressed again, or it must be kept pressed over a period of time (e.g., 2 sec), whereupon the motion is continued. When an LED is lit, this indicates that the corresponding motion is possible from the current position.

If, e.g., the raised position was reached, only the LEDs for lowering 50*a* and for tilting with the head end upward 52*a* are lit.

While specific embodiments of the invention have been shown and described in detail to illustrate the application of the principles of the invention, it will be understood that the invention may be embodied otherwise without departing from such principles.

The invention claimed is:

1. A thermotherapy device for treating newborns, the thermotherapy device comprising:

a device structure;

a platform with a reclining surface bordered by side walls, the platform being connected to the device structure;

a hood movable between a closed incubator position, in which the hood is in contact with the side walls and covers the reclining surface, for incubator operation, and an open nursing care position releasing the bordered reclining surface for open nursing care;

a heating radiator secured to the device structure and directed at the bordered reclining surface;

a lifting means acting on the platform; and a control means set up to make a tilt angle of the platform in relation to a horizontal plane adjustable by actuating the lifting means, wherein the platform is mounted vertically adjustably and the control means is setup, further, by actuating the lifting means in a direction, to make a vertical position of the platform in relation to the side walls adjustable at least between a first position and a second position, which is raised relative to the first position, the device structure comprising a housing chassis, a support chassis and a lifting column, the lifting means being mounted in the housing chassis and the lifting means carrying the platform in the housing chassis, the housing chassis being carried by the lifting column and the lifting column being supported on the support chassis, the control means being set up to control the operation of the lifting means and of the lifting column in such a coordinated manner that the platform rests, in a vertical position, while the lifting column is lowered and the lifting means is raised or while the lifting column is raised and the lifting means is lowered.

2. A thermotherapy device in accordance with claim 1, wherein the lifting means comprises electrically driven telescopic devices.

3. A thermotherapy device in accordance with claim 1, wherein the lifting means comprises slidable lattice grates, which are driven via nuts and motor-driven spindle shafts.

4. A thermotherapy device in accordance with claim 1, wherein the lifting means comprises motor-driven pivoted levers.

5. A thermotherapy device in accordance with claim 4, wherein:

the platform is provided in a central region with a laterally extending pin, which meshes with a vertical guide, so that the pin is displaced in the vertical guide during a raising of the platform; and the pin rotates in the vertical guide during a pivoting of the platform.

6. A thermotherapy device in accordance with claim 1, wherein the control means comprises a keyboard comprising four keys, the four keys comprising a first key, a second key, a third key and a fourth key, wherein the platform can be controlled via the lifting means by the keyboard comprising the four keys in such a way that the actuation of the first key brings about a pure lifting motion of the platform, such that actuation of the second key brings about a pure lowering motion of the platform, such that the actuation of the third key brings about a pure tilting motion of the platform in one direction, and such that the actuation of the fourth key brings about a pure tilting motion of the platform in an opposite direction.

7. A thermotherapy device in accordance with claim 6, wherein the control means is set up to continue a resulting motion of the platform when one of the keys is pressed only if a corresponding key is kept pressed and to stop the resulting motion automatically when a next normal or end position is reached.

8. A thermotherapy device in accordance with claim 1, wherein the control means is set up to determine a position of the platform relative to the heating radiator by means of actuating signals of electric motor drives and to adapt an output of the heating radiator as a function of the determined position of the platform relative to the heating radiator.

9. A thermotherapy device in accordance with claim 1, wherein the platform does not move in a vertical direction during raising and lowering of the lifting column such that a same distance between the platform and a floor plane is maintained during raising and lowering of the lifting column in the vertical direction, the lifting column being actuated via said lifting column drive such that [ [said]] a housing and the lifting column only move linearly, wherein said housing and said lifting column only move up and down in the vertical direction.

10. A thermotherapy device for treating newborns, the thermotherapy device comprising:

a housing;

side walls supported by the housing;

a platform with a reclining surface bordered by the side walls;

a lifting device connected to the housing and lifting the platform relative to the housing;

a hood movable between a closed incubator position, in which the hood is in contact with the side walls and covers the reclining surface, for incubator operation, and an open nursing care position releasing the bordered reclining surface for open nursing care;

a heating radiator arrangement connected to the housing and directed at the reclining surface;

a control device configured to actuate the lifting device to adjustably set a tilt angle of the platform in relation to a horizontal plane and to actuate the lifting device to change a vertical position of the platform in relation to the side walls at least between a first position and a second position, which is raised relative to the first position;

a support chassis; and a lifting column supported on the support chassis, the lifting device being mounted in the housing and the lifting device carrying the platform in the housing, the housing being carried by the lifting column, the lifting column being supported on the support chassis, the lifting column having a lifting column drive, the control device being configured to control, in a coordinated manner, both the lifting device during operation and the lifting column drive during operation including lowering the lifting column while the lifting device raises the platform and raising the lifting column while the lifting device lowers the platform.

11. A thermotherapy device in accordance with claim 10, wherein the lifting device comprises a plurality of electrically driven telescopic devices, the control device being configured to synchronize vertical movement of the lifting column with movement of the lifting device such that the platform is maintained at a same distance from a floor plane during raising and lowering of the lifting column in a vertical direction, the lifting column being actuated via the lifting column drive such that the housing and the lifting column only move linearly, wherein the housing and the lifting column only move up and down in the vertical direction.

12. A thermotherapy device in accordance with claim 10, wherein the lifting device comprises:

a plurality slidable lattice grates;

a plurality of nuts; and a plurality of motor-driven spindle shafts.

13. A thermotherapy device in accordance with claim 10, wherein the lifting device comprises a plurality of motor-driven pivoted levers.

14. A thermotherapy device in accordance with claim 13, wherein:

the platform is provided in a central region with a laterally extending pin engaging with a vertical guide so that the pin is displaced in the vertical guide during a raising of the platform; and the pin rotates in the vertical guide during a pivoting of the platform.

15. A thermotherapy device in accordance with claim 10, wherein the control device comprises a keyboard comprising four keys, the four keys comprising a first key, a second key, a third key and a fourth key, wherein a position of the platform is controlled via the lifting device by means of the four keys such that actuation of the first key brings about a pure lifting motion of the platform, the actuation of the second key brings about a pure lowering motion of the platform, the actuation of the third key brings about a pure tilting motion of the platform in a direction, and the actuation of the fourth key brings about a pure tilting motion of the platform in an opposite direction.

16. A thermotherapy device in accordance with claim 15, wherein the control device is configured to continue a motion of the platform when one of the four keys is pressed only if a corresponding key is kept pressed and to stop the motion automatically when a next normal or end position is reached.

17. A thermotherapy device in accordance with claim 10, wherein:

the heating radiator arrangement comprises one or more heating radiator with a radiation output controlled by the control device;

the lifting device comprises electric motor drives; and the control device is configured to determine a position of the platform relative to the one or more heating radiator based on actuating signals sent to the electric motor drives or signals received from the electric motor drives and the control device is configured to adapt the radiation output of the one or more heating radiator based on a function of a determined position of the platform relative to the one or more heating radiator.

18. A thermotherapy device for treating newborns, the thermotherapy device comprising:

a housing;

side walls supported by the housing;

a platform with a reclining surface bordered by the side walls;

a lifting device connected to the housing and lifting the platform relative to the housing;

a hood movable between a closed incubator position, in which the hood is in contact with the side walls and covers the reclining surface, for incubator operation, and an open nursing care position releasing the bordered reclining surface for open nursing care;

a heating radiator arrangement connected to the housing and directed at the reclining surface;

a control device configured to actuate the lifting device to adjustably set a tilt angle of the platform in relation to a horizontal plane and to actuate the lifting device to change a vertical position of the platform in relation to the side walls at least between a first position and a second position, which is raised relative to the first position;

a support chassis; and a lifting column supported on the support chassis, the lifting device being mounted in the housing and the lifting device carrying the platform in the housing, the housing being carried by the lifting column, the lifting column being supported on the support chassis, the lifting column having a lifting column drive, the control device being configured to synchronize vertical movement of the lifting column with movement of the lifting device such that the platform maintains a same distance from a floor plane during raising and lowering of the lifting column in a vertical direction.

19. A thermotherapy device in accordance with claim 18, wherein the control device is configured to control, in a coordinated manner, both the lifting device during operation and the lifting column drive during operation including lowering the lifting column in the vertical direction while the lifting device raises the platform in the vertical direction and raising the lifting column in the vertical direction while the lifting device lowers the platform in the vertical direction.

20. A thermotherapy device in accordance with claim 17, wherein the lifting column is actuated via said lifting column drive such that said housing and the lifting column only move linearly, wherein said housing and said lifting column only move up and down in the vertical direction.

* * * * *